United States Patent [19]

Watanabe et al.

[11] Patent Number: 4,967,583

[45] Date of Patent: Nov. 6, 1990

[54] METHOD OF MANUFACTURING EXTRUDED SEAMLESS HOLLOW MATERIALS

[75] Inventors: Toshio Watanabe; Atsumi Takasugi; Kazumi Kato; Hirokazu Yamaguchi, all of Tochigi, Japan

[73] Assignee: Furukawa Aluminum Co., Ltd., Tokyo, Japan

[21] Appl. No.: 423,585

[22] Filed: Oct. 17, 1989

Related U.S. Application Data

[63] Continuation of Ser. No. 172,898, Mar. 25, 1988, abandoned.

[30] Foreign Application Priority Data

Jun. 27, 1987 [JP] Japan ..... 62-160093

[51] Int. Cl.[5] ..... B21C 23/08; B21C 25/04

[52] U.S. Cl. ..... 72/264

[58] Field of Search ..... 72/264–266

[56] References Cited

U.S. PATENT DOCUMENTS

| | | | |
|---|---|---|---|
| 1,400,071 | 12/1921 | Jacobsen | 72/266 |
| 2,893,553 | 7/1959 | Kreidler | 72/266 |
| 3,347,079 | 10/1967 | Rowell | 72/264 |
| 4,104,903 | 8/1978 | Rowell et al. | 72/264 |

FOREIGN PATENT DOCUMENTS

| | | | |
|---|---|---|---|
| 2123528 | 11/1972 | Fed. Rep. of Germany | 72/264 |
| 6656 | 3/1967 | Japan | 72/264 |
| 33429 | 8/1972 | Japan | 72/266 |
| 82650 | 7/1978 | Japan | 72/264 |
| 56-720 | 5/1981 | Japan | 72/264 |
| 6616 | of 1904 | United Kingdom | 72/264 |

OTHER PUBLICATIONS

The Extrusion of Metals, by Pearson and Parkins (1960), pp. 85–88.

Assoc. of Light Metals ed., "Aluminum Handbook", 1st ed., pp. 461–462 (1963), Asakura Shoten.

Former Light Metal Rolling Committee of Industry and Aluminum Handbook Editorial Committee ed., "Aluminum Handbook".

*Primary Examiner*—Robert L. Spruill

*Attorney, Agent, or Firm*—Armstrong, Nikaido, Marmelstein, Kubovcik & Murray

[57] ABSTRACT

A method of manufacturing extruded seamless hollow materials characterized in that, prior to extruding a hollow billet from container liner through extrusion dies, a process wherein a centering jig for holding the tip portion of mandrel at the center of extrusion is provided on the extruding side or in the extrusion dies on the extruding side of the container liner, a process wherein the tip portion of mandrel is inserted into the centering jig to be held and a process wherein the hollow billet is pressurized to fill up said billet in the container liner are included.

1 Claim, 3 Drawing Sheets

METHOD OF MANUFACTURING EXTRUDED SEAMLESS HOLLOW MATERIALS

This application is a continuation of application Ser. No. 172,898 filed Mar. 25, 1988 abandoned.

BACKGROUND OF THE INVENTION

The present invention relates to a method of manufacturing extruded seamless hollow materials, in particular, to a manufacturing method contrived to reduce the deviation in thickness at the beginning of extrusion.

The manufacturing method of conventional seamless hollow materials will be explained by FIG. 6. The extrusion dies 2 is provided on the extruding side of container liner 1 and a hollow billet "a" is inserted into the container liner 1. The mandrel 3 is inserted into the billet "a" adjusting the sight to the center of extrusion hole 21 of dies 2 and the hollow billet "a" is pressurized by ram 4 to be extruded.

The wall thickness of the extruded hollow materials is determined by the clearance between the outer diameter of mandrel 3 and the extrusion hole 21 of dies 2. But, when starting in the extrusion by pressurizing the billet "a", the tip of mandrel 3 is not accurately kept at the center of extrusion (center of extrusion hole 21 of dies 2) due to the swings etc. Therefore, there has been a drawback that the deviation occurs in the wall thickness of the extruded hollow materials at the beginning of extrusion.

The purpose of the invention lies in providing a method of manufacturing extruded seamless hollow materials wherein the occurrence of such deviation in thickness is lessened.

SUMMARY OF THE INVENTION

In order to attain the purpose aforementioned, one of the manufacturing method according to the invention is characterized in that, prior to extruding a hollow billet from container liner through extrusion dies, a process wherein a centering jig for holding the tip portion of mandrel at the center of extrusion is provided on the extruding side of container liner, a process wherein the tip portion of mandrel is inserted into the centering jig to be held and a process wherein the hollow billet is pressurized to fill up said billet in the container liner are included.

Moreover, other one of the manufacturing method according to the invention is characterized in that, prior to extruding a hollow billet from container liner through extrusion dies, a process wherein in a centering jig for holding the tip portion of mandrel at the center of extrusion is provided in the extrusion dies on the extruding side of container liner, a process wherein the tip portion of mandrel is inserted into the centering jig to be held and a process wherein the hollow billet is pressurized to fill up said billet in the container liner are included.

Figure 6:
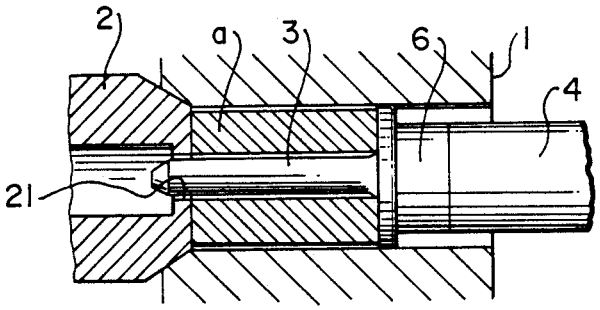
Fig. 6 PRIOR ART

And, FIG. 6 is a partial cross section of the device for illustrating the conventional manufacturing method.

DETAILED DESCRIPTION OF THE INVENTION

Prior to the extrusion, by correctly adjusting the sight of the tip portion of mandrel to the center of extrusion with centering jig and by pressurizing the hollow billet in this state to fill up the container liner and to complete the centering upset, the mandrel is kept more accurately at the center of extrusion. As a result, the deviation in thickness of extruded hollow materials becomes less.

Figure 1:
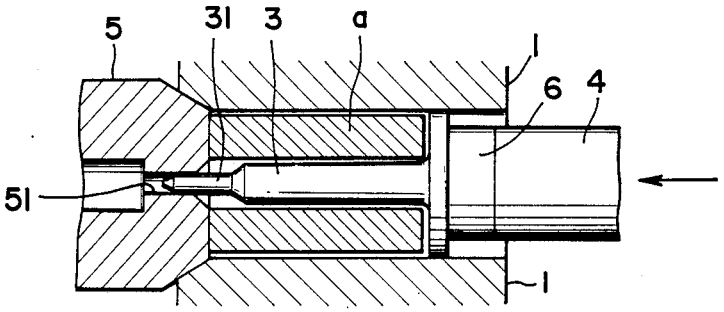
FIG. 1 through FIG. 3 are partial cross sections illustrating one of the manufacturing method according to the invention.
Figure 2:
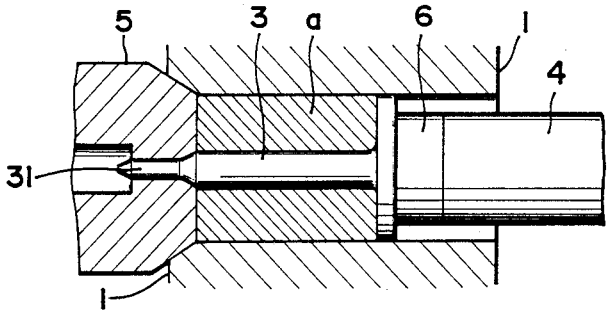
Figure 3:
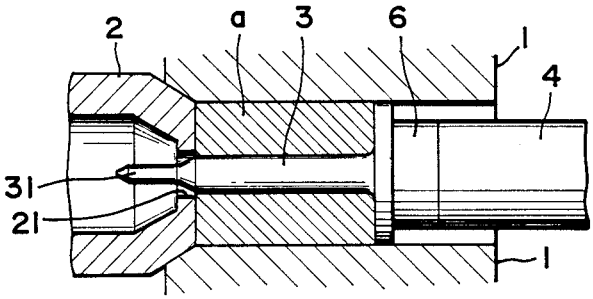

Referring to FIG. 1 through FIG. 3, one of the manufacturing method according to the invention will be illustrated.

Prior to extruding the hollow billet "a" from container liner 1 through extrusion dies 2 in FIG. 3, first, the centering jig 5 for holding the tip of mandrel 3 at the center of extrusion is provided on the extruding side of container liner 1.

In the centering jig 5, a centering hole 51 is formed at the center of extrusion and, into this centering hole 51, the tip of mandrel 3 is inserted to be held. The diameter of mandrel 3 may be same over approximately whole length, but it is desirable to form a centering axis 31 with small diameter at the tip and to constitute in such a state that said centering axis 31 and said centering hole 51 are precisely fit.

Next, the extrusion block 6 is pressurized toward the extruding side by ram 4 to fill up the hollow billet a in the container liner 1 as shown in FIG. 2 and to complete the centering upset.

In the following process, the extrusion jig 5 is removed from the mounted position aforementioned and, after provided the extrusion dies 2 at the position, the billet "a" is extruded according to usual method by pressurizing ram 4 in the direction of extrusion. At this time, since the mandrel 3 stays in a state more accurately kept at the center of extrusion through the completion of the centering upset aforementioned, the deviation in thickness is extremely reduced in this extrusion process.

This manufacturing method can be put easily in practice by using side press dies.

Besides, the dimension specifications of mandrel 3 is appropriately established due to the volume of clearance between inner and outer circumference of hollow billet "a" in the container liner 1 before the centering upset. In the example described above, the dimension specifications are such that the length of hollow billet "a" after the upset and the dimension of the portion of mandrel 3 eliminated the centering axis 31 are approximately consistent at the time of the completion of centering upset.

Figure 5:
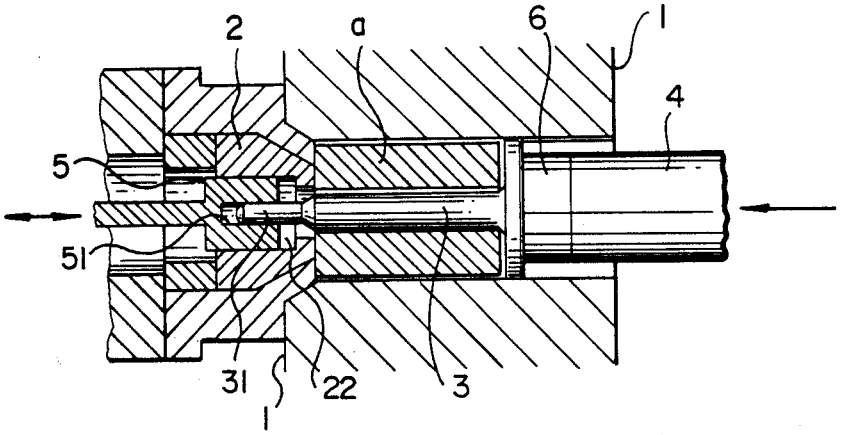
FIG. 5 is a partial cross section of the device for illustrating another one of the manufacturing method according to the invention.

Another one of the manufacturing method according to the invention will be illustrated based on FIG. 5.

In the first place, prior to extruding the hollow billet "a" from container liner 1 through extrusion dies 2, the centering jig 5 is closely inserted into the back hole 22 inside the extrusion dies 2 provided on the extruding side in such a state that it can slide along the back hole 22.

In the centering jig 5, the centering hole 51 is formed at the center of extrusion and, into this centering hole 51, the tip of mandrel 3 is closely inserted to be held. In this case, too, it is desirable to form the centering axis 31 with small diameter at the tip portion of mandrel 3.

Following this, the extrusion block 6 is pressurized toward the extruding side by ram 4 to fill up the hollow billet "a" in the container liner and to complete the centering upset of hollow billet "a".

In this example, when the extrusion block 6 is pressurized and the extrusion starts after the completion of centering upset as described above, the centering jig 5 is simulataneously pushed in the direction of extrusion by mandrel 3 to be ejected. Thus, the exchange of centering jig 5 with extrusion dies 2 is unnecessary.

Since the centering upset is completed as described above at the time of the extrusion of hollow billet "a" and the mandrel 3 is more accurately kept at the center of extrusion, the deviation in thickness of extruded products is extremely lessened.

EXAMPLE

Figure 4:
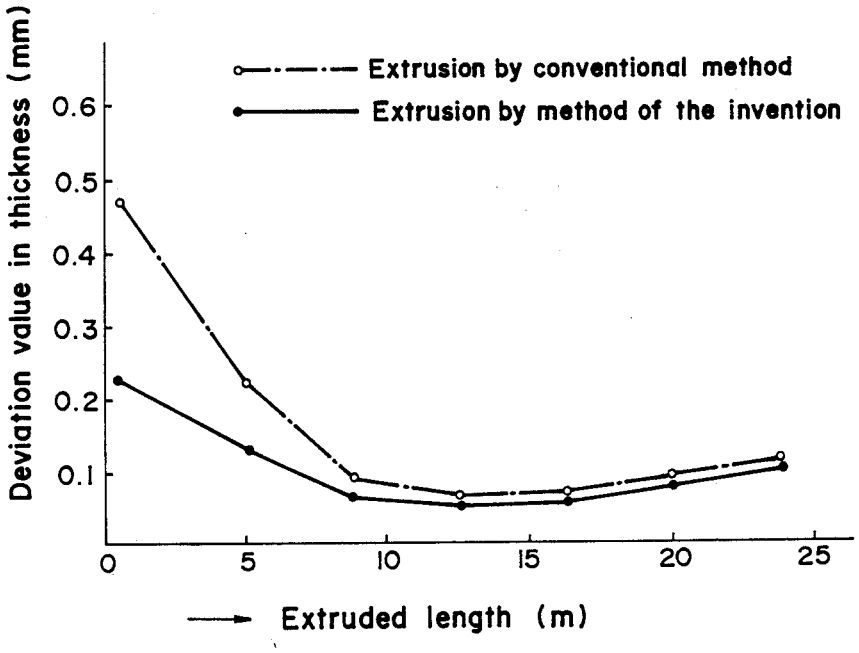
FIG. 4 is a chart showing the deviation values in thickness in the manufacturing example of hollow materials by the manufacturing method of the instant invention and those by conventional method.

According to the method of the invention illustrated refering to FIG. 1 through FIG. 3 and the conventional method, using a hollow billet made of JIS A5052 aluminum alloy, aluminum alloy tubes with an outer diameter of 50 mm, an inner diameter of 40 mm and a wall thickness of 5 mm were extruded at a billet temperature of 500° C. to obtain the results as shown in the graph of FIG. 4.

Besides, in such graph, the extruded length was expressed in an unit of m in the direction of X-axis and the deviation value in thickness was expressed in an unit of mm in the direction of Y-axis. Moreover, the solid line shows the deviation values in thickness of the extruded tube according to the method of the invention and the dotted chain line shows those of the extruded tube according to the conventional method.

As in FIG. 4, the extruded tube by the manufacturing method according to the invention showed extremely reduced deviation in thickness, in particular, at the beginning of extrusion compared with that by the conventional manufacturing method.

Similar extrusion by the method of the invention illustrated by FIG. 5 was tried to obtain approximately similar results to those shown by the solid line in FIG. 4.

In accordance with the method of manufacturing extruded hollow materials of the invention, prior to the extrusion of hollow billet, the centering jig for holding the mandrel at the center of extrusion is provided, the tip of mandrel is inserted into the centering jig and held, in this state, the hollow billet is pressurized and filled up in the container liner to make the centering upset. Therefore, the extruded seamless hollow materials with extremely less deviation in thickness can be manufactured, in particular, at the beginning of extrusion.

What is claimed is:

1. A method for manufacturing extruded seamless hollow products from a hollow billet of extrudable material with a die and an extrusion mandrel from a container liner, said extrusion mandrel having an extrusion portion of fixed diameter for forming a clearance with said die for extruding said extrudable material and a tip portion of smaller diameter comprising the steps of positioning said die at one end of said container liner, positioning said hollow billet of extrudable material in said container liner with one end of said hollow billet at said die end of said container liner, positioning said mandrel in the hollow of said billet with said tip portion of smaller diameter passing through said die, positioning a centering jig on said tip portion of said mandrel on the extrusion side of said die prior to extruding a hollow billet of said extrudable material from said container liner through said extrusion die for centering said extrusion mandrel at the center of said extrusion die, while holding said tip portion in said centering jig, pressurizing said container liner and said hollow billet of said extrudable material to be extruded to extrude said material through said die between said die and said extrusion portion of said mandrel and into an extruded seamless hollow product and, as said extrudable material commences to be extruded between said die and said fixed diameter extrusion portion of said mandrel, with said material being extruded removing said centering jig from the extrusion side of said die and container liner.

* * * * *